United States Patent [19]

Nakajima et al.

[11] Patent Number: 4,561,497

[45] Date of Patent: Dec. 31, 1985

[54] HEAT TRANSFER SURFACE AND MANUFACTURING METHOD FOR SAME

[75] Inventors: Tadakatsu Nakajima, Ibaraki; Wataru Nakayama, Kashiwa; Takahiro Daikoku; Heikichi Kuwahara, both of Ibaraki; Akira Yasukawa; Katsuhiko Kasuya, both of Ibaraki; Kazuaki Yokoi, Ibaraki; Hideo Nakae, Tokyo; Hiromichi Yoshida, Hitachi, all of Japan

[73] Assignees: Hitachi, Ltd.; Hitachi Cable Ltd., both of Tokyo, Japan

[21] Appl. No.: 561,070

[22] Filed: Dec. 14, 1983

[30] Foreign Application Priority Data

Dec. 17, 1982 [JP] Japan ..... 57-220081

[51] Int. Cl.[4] ..... F28F 13/18

[52] U.S. Cl. ..... 165/133; 29/157.3 R

[58] Field of Search ..... 62/527; 165/133

[56] References Cited

U.S. PATENT DOCUMENTS

| | | | |
|---|---|---|---|
| 3,384,154 | 5/1968 | Milton | 165/1 |
| 3,566,514 | 3/1971 | Szumigala | 165/133 |
| 3,768,290 | 10/1973 | Zatell | 165/133 |
| 4,060,125 | 11/1977 | Fujie et al. | 165/133 |
| 4,159,739 | 7/1979 | Brothers et al. | 165/133 |
| 4,166,498 | 9/1979 | Fujie et al. | 165/133 |
| 4,195,688 | 4/1980 | Fujie et al. | 165/133 |
| 4,216,826 | 8/1980 | Fujikake | 165/133 |
| 4,245,695 | 1/1980 | Fujikake | 165/133 |
| 4,474,231 | 10/1984 | Staub et al. | 165/133 |

FOREIGN PATENT DOCUMENTS

| | | | |
|---|---|---|---|
| 172193 | 10/1982 | Japan | 165/133 |

OTHER PUBLICATIONS

Heat Transfer Engineering vol. 2, Nos. 3–4, Jan.–Jun. 1981, pp. 46–69.

*Primary Examiner*—Albert W. Davis, Jr.
*Assistant Examiner*—Peggy A. Neils
*Attorney, Agent, or Firm*—Antonelli, Terry & Wands

[57] ABSTRACT

In a heat transfer surface having cavity groups and restricted opening groups in an outer surface region, the cavity groups are composed of a plurality of rows of void strip members. The cavity strip members are arranged in parallel on a base member of the heat transfer surface and are laminated in one or more layers. Each strip member has a number of elongate cavities laterally arranged in parallel. The elongate cavities are closed at upper surfaces and have at both ends openings. The adjacent cavities in the same layer are communicated with each other by communicating portions each provided between the cavity strip members and by the openings. The restricted opening groups are formed on the upper surfaces of the communicating portions. The restricted opening groups render the communicating portions in one layer, the communicating portions in another layer and the outside to communicate with each another. The method of manufacturing such a heat transfer surface is also disclosed.

5 Claims, 15 Drawing Figures

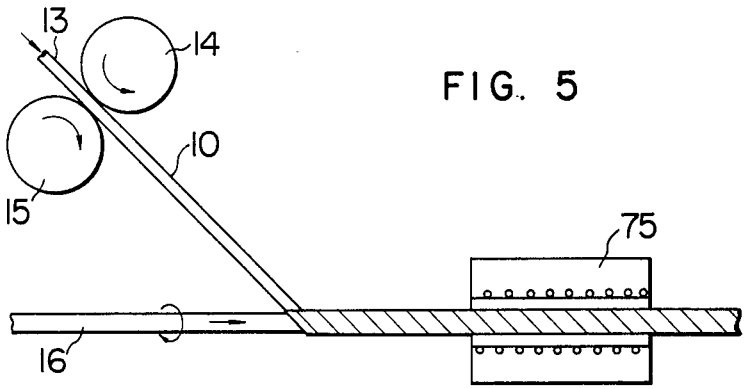
FIG. 5
FIG. 6
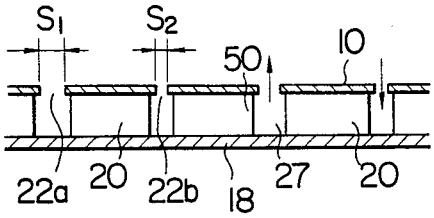
FIG. 7
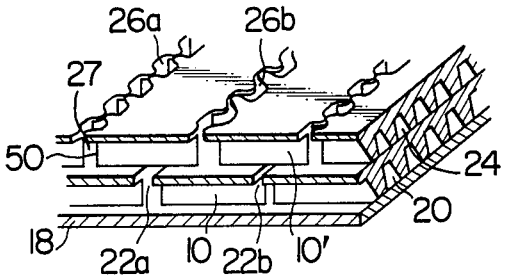

HEAT TRANSFER SURFACE AND MANUFACTURING METHOD FOR SAME

BACKGROUND OF THE INVENTION

The present invention relates to a heat transfer surface capable of transferring heat by phase-changing liquids which are brought into contact with outer surfaces of its planar plate or heat transfer tube, and more particularly, to a heat transfer surface for use in an evaporator or radiator.

There have been heretofore proposed a number of techniques as to a heat transfer surface for enhancing boiling or evaporating heat transfer. For example, a heat transfer surface covered with a porous layer described in U.S. Pat. No. 3,384,154. The surface having such a porous layer is known to exhibit higher heat transfer performance than that of a conventional smooth surface. However, in such a porous layer, since voids or cavities formed therein are small, impurities contained in boiling liquid contained therein will enter into the voids or cavities to clog them so that the heat transfer performance of the surface will be degraded. Also, since the voids or cavities are thin or narrow, a great amount of boiling liquid will enter into the voids or cavities due to the capillary force thereby cooling the heat transfer surface. As a result, since the generation and growth of vapor bubbles would be suppressed, the heat transfer performance would be degraded in a low heat flux region.

Also, since the voids or cavities formed in the porous layer are non-uniform in size or dimension, the heat transfer performance is locally changed.

On the other hand, as disclosed in U.S. Pat. No. 4,060,125, there has been known a heat transfer wall or surface having a number of tunnels and limited openings.

With such a heat transfer surface, to obtain a high heat transfer performance, it is necessary that a thin liquid film be formed on wall surfaces of the tunnels. In other words, under such a condition that the tunnels are filled with invading liquid or vapor, it is impossible to obtain a higher heat transfer performance. Such a condition of the liquid and vapor in the tunnels is determined by the vapor pressure of vapor bubbles in the tunnels and the fluid resistance of the liquid and vapor at the restricted openings. Namely, the vapor generating rate is decreased at a region where a heat flux is relatively small, so that the vapor pressure in the tunnels is also decreased. Moreover, the number of the restricted openings from which the bubbles will be removed (which will be hereinafter referred to as an "active opening") is decreased whereas the number of the restricted openings into which the liquid will enter (which will be hereinafter referred to as an "inactive opening") is increased. Accordingly, the liquid may readily enter into the tunnel and the interiors of the tunnels are liable to be filled with the liquid. On the other hand, a region where a heat flux is relatively large is kept under a condition essentially opposite to that described above, and the tunnels are liable to be filled with vapor. Accordingly, it is impossible to keep a higher heat transfer coefficient in a wide heat flux range even with the above-described heat transfer surface. In particular, there is a serious problem in performance degradation at a lower heat flux range which has been widely utilized for the industrial purposes.

Also, since the selection of the active and inactive openings depends upon non-uniformity of machining, it is inevitable that the heat transfer performance is greatly changed among individual products.

SUMMARY OF THE INVENTION

An object of the invention is to provide a heat transfer surface and a manufacturing method therefor, in which a higher heat transfer coefficient is ensured at a lower heat flux range and a performance is kept unchanged among final products.

This and other objects may be attained by laminating, on a base member of a heat transfer wall in parallel and in a one-or-more lamination manner, or more surface strips each having a plurality of cavity strip plate members in which a number of thin parallel cavities are laterally arranged and projections extending perpendicular to the longitudinal direction of the cavity strip members, and forming communicating portions and restricted openings between adjacent cavity strip members by utilizing the projections. According to this invention, it is possible to separate regularly the restricted openings into active openings and inactive openings as desired and to supply the cavities with a suitable amount of liquid. Also the manufacturing method thereof is easy and inexpensive.

BRIEF DESCRIPTION OF THE DRAWINGS

In the accompanying drawings:

FIG. 5 is a view showing an example of the manufacturing method of the heat transfer surface according to the present invention;

FIGS. 6 and 7 are views of another embodiment of the invention;

DETAILED DESCRIPTION OF THE PREFERRED EMBODIMENTS

The heat transfer surface and the manufacturing method therefor in accordance with the invention will now be described in detail by way of example.

Figure 1:
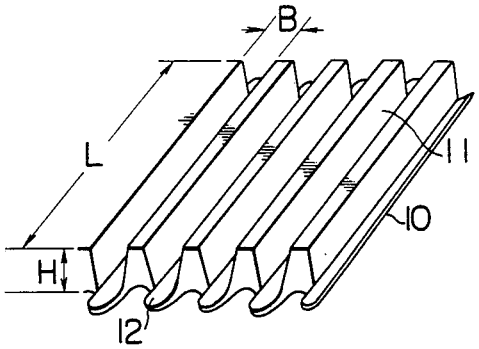
FIG. 1 is a perspective view of an example of an elongate tape-like thin plate forming a surface portion of a heat transfer surface according to the present invention.

As shown in FIG. 1, a number of elongate grooves 11 having minute dimensions are formed laterally and in parallel with each other on an elongate tape-like thin plate 10 which in turn forms a surface layer of the heat transfer wall. The grooves 11 are formed through a machining process such as cutting or groove-forming, a plastic forming process such as rolling or pressing, or a molding process such as die-casting. One of the above-described various processes is suitably selected according to the material to form the thin plate 10. For instance, the plastic rolling process is preferable for a material having a high ductility such as copper and the molding process is preferable for a fragible material such as ceramics. According to any of the above described processes, projections 12 are formed at end faces of the tape-like thin plate 10 at the same pitch or interval as that of the grooves 11. Both height H and width B of the grooves are preferably 0.15 mm or more, the pitch of the grooves 11 is preferably 1 to 20 ea (pieces)/cm and length L of the thin plate 10 is preferably about 1.0 to 10.0 mm.

Figure 2:
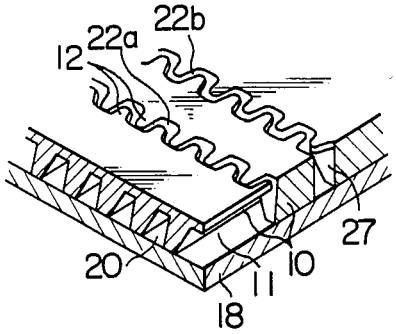
FIG. 2 is a perspective view showing one embodiment using the tape-like thin plate shown in FIG. 1.

FIG. 2 shows an embodiment of the heat transfer surface in accordance with the invention. In the embodiment, the above-described elongate tape-like thin plates 10 are regularly arranged on a planar heat transfer wall base member 18 with the grooves being directed downwardly. At this time, strip-shaped regions of under-surface cavities 20, i.e., strip-shaped cavities are formed between the grooves and the heat transfer surface base member 18 whereas restricted openings *22a, 22b* are formed between the projections 12 formed at the end faces of the adjacent different tape-like thin plates 10. Incidentally, the opening area ratio is preferably selected in a range of between about 0.01 and 0.30.

The size or dimension of the restricted openings *22a, 22b* are changeable by varying the phase of arrangement of the tape-like thin plate 10 adjacent to each other. Namely, when the phase of arrangement is displaced by 180° (½ pitch), the projections 12 are positioned between the projections 12, 12 of the laterally adjacent tape-like thin plate 10 whereupon the restricted openings 22 become smallest in size. On the other hand, when the phase displacement is selected as 0° (there is no displacement in phase), the projections are confronted with the projections 12 of the laterally adjacent tape-like thin plate 10 whereupon the restricted openings 22 become largest in size. Accordingly, by displacing regularly the adjacent tape-like thin plates 10 in phase and arranging them on the heat transfer surface base member 18, a heat transfer surface may be obtained in which the larger openings and smaller openings 22 are regularly formed.

Figure 3:
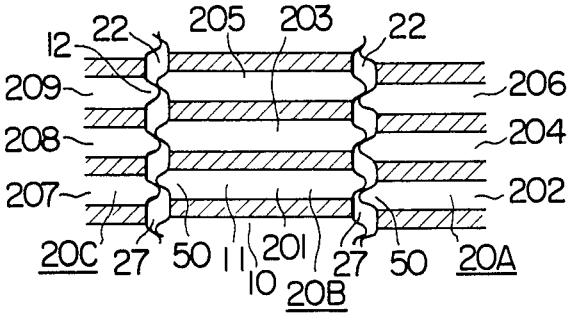
FIG. 3 is a bottom view of the surface strip member shown in FIG. 2.

FIG. 3 shows a bottom view of the surface layer region in the embodiment shown in FIG. 2. At the end face portions of the respective cavities 20 (201, 202, . . . ) including strip-shaped cavities 20A, 20B and 20C, there are formed non-restricting openings and communicating portions 27 for communicating the respective cavities 20 to each other. For example, the cavity 203 is communicated with the adjacent cavities 201, 202, 204, 205, 206, 207, 208 and 209 through the communicating portion 27.

When the thus formed heat transfer surface is heated at a higher temperature than that of boiling liquid contacting with the surface, vapor bubbles are generated in the cavities 20, are spread over the entire cavities through the communicating portions 27 communicating the respective cavities 20 to each other, and form thin films on the wall surfaces of the cavities 20. When heating is further continued, the vapor bubbles grow in the cavities 20. Then, when the pressure of the vapor bubbles becomes higher than that of the outside liquid, the vapor bubbles grow and separate at the restricted openings 22 where the vapor fluid resistance is smaller. On the other hand, due to the pressure drop in the cavities 20 in compliance with the growth and separation of the bubbles at the restricted openings 22 of larger cross sectional area, the outside liquid will enter into the cavities 20 through the restricted openings 20 of smaller cross sectional area.

Figure 4:
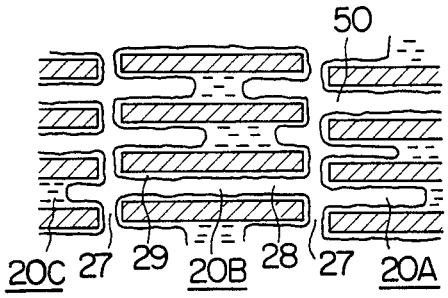
FIG. 4 is a schematic view of vapor bubbles in a lower heat flux range in the heat transfer surface shown in FIG. 2.

FIG. 4 shows a schematic view of the vapor bubbles at a relatively low heat flux range in the cavities of the surface layer region. Since all the adjacent cavities 20 are communicated with each another through the communicating portions 27 between the strip-shaped cavities 20A, 20B and 20C, all the cavities are activated, so that even at the lower heat flux range, the vapor bubbles 28 and the liquid films 29 may be formed in the respective cavities.

FIG. 5 shows an example for performing a plastic process by rolling as a method for forming the surface layer thin plate for a heat transfer surface. A roll means includes on one side a plain roll 14 and on the other side a gear roll 15 on which teeth of involute tooth form having a minute pitch are formed in a direction perpendicular to the rolling direction. An elongate plate or wire 13 which is a raw material is supplied between the rolls. The material is made of non-coated material which is capable of being roll-formed or material which is coated with metal such as Sn, solder material or any other material through which a bonding characteristic may be enhanced with a tube (heat transfer surface base member). The elongate plate or wire 13 which is subjected to a plastic deformation by the roll means is used as the thin plate 10 formed as shown in FIG. 1. Namely, the elongate plate or wire is subjected to a remarkable plastic deformation by the tooth portions of the gear roll 15 so that the thin plate 10 is formed by the tip portions of the teeth and a number of elongate fine grooves 11 are formed by the teeth in parallel with each another. At the same time, due to the remarkable plastic deformation at both ends of the elongate plate by the tip portions of the teeth, the projections 12 are formed at both the ends of the thin plate 10. In this case, a configuration, size and pitch of the grooves may be adjusted as desired by changing the teeth of the roll 15 and in addition, a thickness of the thin plate 10 and a dimension of the projections 12 may readily be adjusted as desired by changing the rolling pressure between the rolls.

In order to form the surface layer of the heat transfer surface, the thus obtained thin plate 10 is wound around a tube member 16 in a single or plural laminate manner with the surface on which the grooves 11 are formed being directed downwardly. At this time, in order to enhance the contacting characteristics between the tube member 16 and the thin plate 10, the tube member 16 is normally subjected to a constant rotational force and fed in compliance with the winding pitch of the formed thin plate.

The restricted openings of various configuration and dimension are formed by the projections 12 of the thin plate 10. By selecting the ratio of the tube diameter of the heat transfer tube member to the effective diameter of the gear roll 15 or the pitch of the teeth thereof, the apex portions of the projections 12 are confronted with each other to form the maximum openings, and by displacing the pitch by ½, the minimum openings are formed. With the maximum and minimum openings, the restricted openings are continuously and regularly arranged. The size of the restricted openings may readily be adjusted also by changing the pressure between the rolls.

In order to enhance the contacting characteristic between the tube member 16 and the formed elongate plate, the tube thus obtained is continuously heated by an inactive gas lamp 75 or under a vacuum condition to thereby obtain a metallurgical bond therebetween.

In an embodiment shown in FIG. 6, the above-described elongate tape-like thin plates 10 are regularly arranged at constant intervals $S_1$, $S_2$ with the interval $S_1$ being wider than the interval $S_2$. In the embodiment, the restricted openings 22*a* formed corresponding to the wider interval $S_1$ are used for separating bubbles whereas the restricted openings 22*b* formed corresponding to the narrower interval $S_2$ are used for absorbing liquid.

When the thus obtained heat transfer surface is heated at a higher temperature than that of the boiling liquid which contacts with the surface, vapor bubbles are generated in the cavities 20 and are spread over all the cavities through the communicating portions 27 for communicating the respective cavities with each other, so that thin liquid films are formed on the cavities 20 wall surfaces. When the heating is further continued, the vapor bubbles within the cavities 20 grow so that the pressure of the vapor bubbles are higher than that of the outside liquid. At the larger openings 22*a*, where the vapor fluid resistance is smaller, of the restricted openings, a part of the vapor bubbles grows into separating bubbles. On the other hand, due to the pressure drop within the cavities 20 according to the growth and separation of bubbles at the larger openings 22*a*, the outside liquid will enter through the smaller openings 22*b* and be supplied in the cavities 20. As is apparent from the foregoing description, the interchange between gas and liquid within the cavities is carried out in a one-way manner. The evaporation of liquid films in the cavities, the growth and separation at the larger openings, the absorption of liquid from the smaller openings, and the replenishment of liquid into the cavities are smoothly performed. Accordingly, the pressure variation in the cavities is suppressed in a narrower range and is inactive. It is, therefore, possible to prevent a pulsating unstable repeated cycle in which the condition where the liquid is excessively absorbed and the condition where the liquid is dried are alternately present. As a result, heat may be transferred with a smaller superheat of heat transfer wall.

In another embodiment shown in FIG. 7, the above-described elongate tape-like thin plates 10, 10' are provided on the heat transfer surface base member 18 in a two-laminate manner. In the heat transfer surface obtained in accordance with this embodiment, a combination of the cavities, openings and communicating holes is present in the upper and lower layers. Therefore, the cavities 20 in the lower layer are communicated with the cavities 24 in the upper layer through the restricted openings 22*a*, 22*b* in the lower layer, and the cavities 24 in the upper layer are communicated with the outside liquid through the restricted openings 26*a*, 26*b* in the upper layer. Furthermore, the respective cavities in the lower layer and the respective cavities in the upper layers are communicated with each other through the non-restricted openings 50 and the communicating portions 27.

Figure 8:
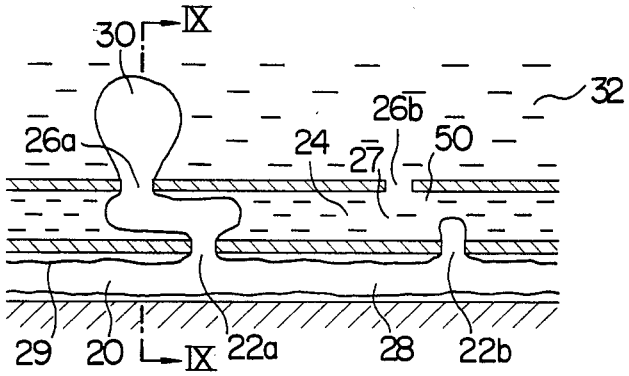
FIGS. 8 and 9 are schematic views of the boiling state in a lower heat flux range in the embodiment shown in FIG. 7, FIG. 9 being a cross-sectional view taken along the line IX—IX of FIG. 8.
Figure 9:
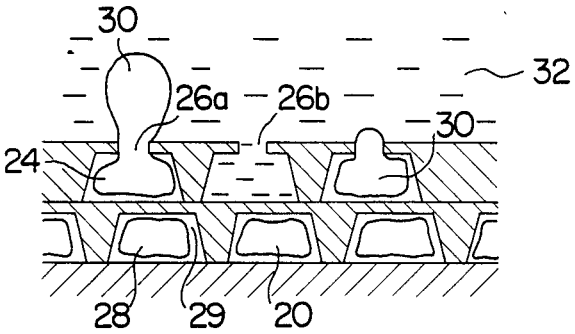

When the thus constructed heat transfer surface is heated at temperature higher than that of the liquid which contacts with the surface, as shown in FIGS. 8 and 9, vapor bubbles 30 are generated in the cavities 20, 24 in the upper and lower layers and the vapor bubbles are spread in the respective cavities through the communicating portions communicating the cavities in the same layer. Then, when the pressure of vapor in the cavities 20 in the lower layer is higher than that of vapor in the cavities 24 in the upper layer, a part of the vapor bubbles 30 is discharged to the cavities 24 in the upper layer through the openings 22*a* in the lower layer. The remainder of the vapor bubbles is retained in the cavities 20 in the lower layer as residual vapor. On the other hand, the upper layer cavities 24 receive the discharged vapor from the lower layer cavities 20 and vapor is generated due to the heating of the cavities 24 per se. Therefore, the pressure in the cavities 24 is higher than that of the outside liquid 32. A part of vapor in the upper layer cavities 24 is discharged through the upper layer restricted openings 26 to the outside liquid as departing bubbles. The remainder of the vapor is retained in the upper layer cavities 24 as residual vapor bubbles 30. Therefore, the pressure in the cavities is higher than that of the liquid outside of the heat transfer surface. Thus, the pressure in the cavities is increased in the order from the upper layer to the lower layer. As the vapor is discharged from the openings 22*a*, 26*a*, the pressure in the cavities 20, 24 is changed, whereupon the liquid will enter into the cavities 20, 24 through the openings 22*b*, 26*b*. In the upper layer cavities 24, the outside liquid 32 will enter and in the lower layer cavities 20, a part of the entering liquid in the upper layer cavities 24 will enter into the lower layer cavities 20. Therefore, since in the lower layer cavities 20, the pressure in the cavities 20 is higher and the liquid to enter thereinto passes through the upper layer cavities 24, the resistance against the entrance of the liquid 32 is large and a limited amount of liquid will be introduced thereto. For this reason, even at a lower heat flux range, thin liquid films 29 are formed on inner surfaces of the lower layer cavities 20 to thereby provide a higher heat transfer coefficient.

Figure 10:
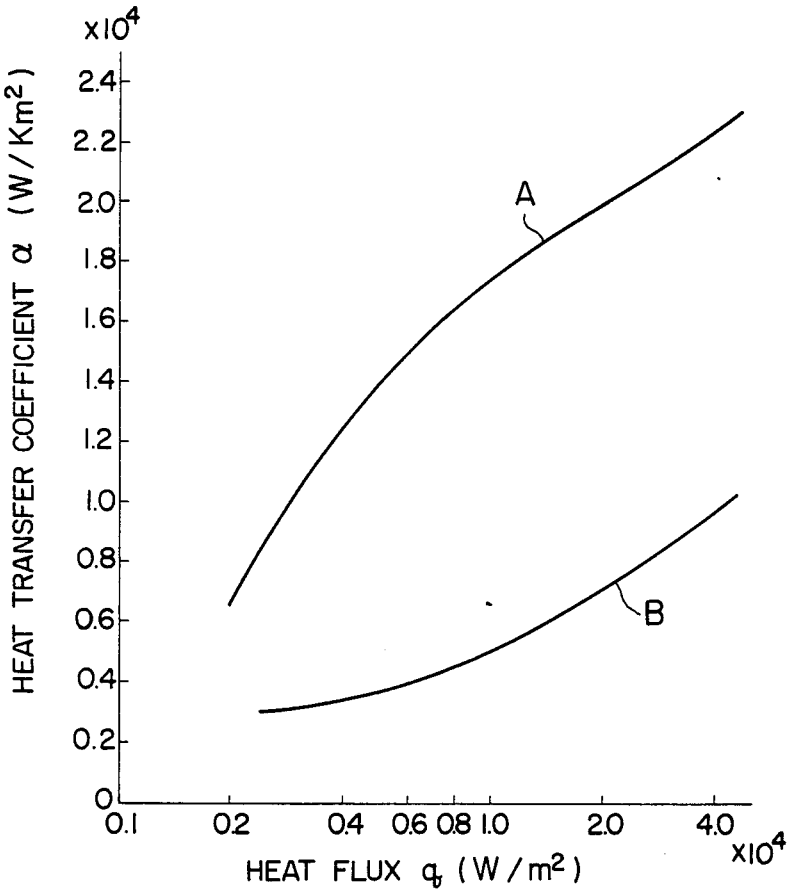
FIG. 10 is a graph showing the comparison in performance between the embodiment shown in FIG. 7 and the prior art.

To confirm an excellent heat transfer performance of the heat transfer surface according to the invention, a boiling heat transfer experiment was conducted under the atmospheric pressure by using the heat transfer surface shown in FIG. 7. Boiling liquid was $CFCl_3$ (Freon R-11). The heat transfer surface was made of copper. A width of the upper and lower tape-like thin plates was 2 mm, and a thickness thereof was 0.6 mm. The heat transfer performance is shown in FIG. 10 by A. B in FIG. 10 corresponds to the performance of the heat transfer surface in accordance with an embodiment shown and described in U.S. Pat. No. 4,060,125. The abscissa denotes the heat flux q ($W/m^2$) with respect to the projection area of the heat transfer surface and the ordinate denotes the heat transfer coefficient $\alpha$ ($W/m^2k$) with respect to the above-described projection area.

Since the heat transfer surface shown in FIG. 7 is of the two-layer type, the actual heat transfer area thereof is about twice the area of the above-described prior art heat transfer surface. However, the heat transfer coefficient of the invention is indicated by A in FIG. 10 and exceeds twice the heat coefficient of B in FIG. 10.

The heat transfer surface of the embodiment shown in FIG. 7 is suitable particularly for the case where a liquid such as Freon which is easy to wet the wall surfaces and to flood the cavities is used as the boiling liquid.

Figure 11:
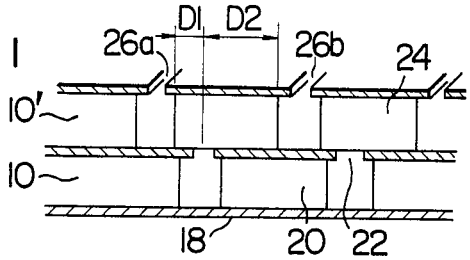
FIGS. 11 and 12 are views showing another embodiment of a heat transfer surface according to the invention.

In another embodiment shown in FIG. 11, upper and lower layer elongate tape-like thin plates 10, 10' are provided on a heat transfer surface base member 18 so that a distance D1 is shorter than a distance D2. In the thus formed heat transfer surface, the vapor discharged from the lower layer restricted openings 22 is further discharged to the outside through restricted opening 26*a* corresponding to the upper layer cavities 24 whose flow path is shorter in length, that is, the distance D1. The liquid will enter into the cavities through the restricted openings 26*b* corresponding to the distance D2.

Figure 12:
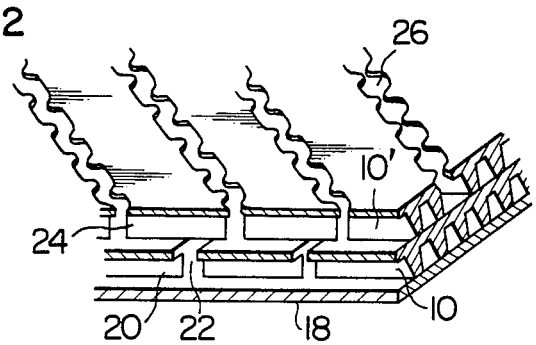

In another embodiment shown in FIG. 12, upper and lower layer elongate tape-like thin plates 10, 10' are provided on a heat transfer surface base member 18 so that they are arranged in a cross manner. Substantially the same effect obtained in accordance with the embodiment shown in FIG. 11 may be obtained.

Figure 13:
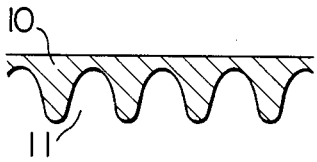
FIGS. 13 through 15 are views showing modifications or variants of the tape-like thin plate according to the invention.
Figure 14:
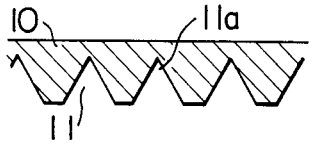
Figure 15:
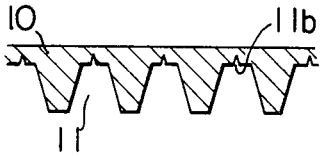

Although in the embodiment shown in FIG. 1, a thin plate or wire is rolled by a fine pitch gear of trapezoidal teeth, by selecting tooth forms suitably as shown in FIGS. 13 through 15, grooves having various forms (hence, grooves having different projections in shape and size at their end faces) may be obtained. In an example shown in FIG. 13, the grooves are formed by an arcuate tooth form or an involute tooth form and the projections to be formed at the groove end faces has a form which is short in elongated length and is diverged outwardly. Therefore, when the heat transfer surface is formed by such a grooved tape, a heat transfer surface having restricted openings of smaller opening diameter may be obtained. An example shown in FIG. 14 is rolled by a triangular tooth form, so that arcuate corners 11*a* are formed at the bottoms of the grooves 11 and the projections are also in the acute form. Therefore, the heat transfer surface composed of this grooved tape is suitable for liquid such as water which has a poor wettability. An example shown in FIG. 15 is rolled by a two-stage tooth form, so that shallow grooves 11*b* are further formed on bottom surfaces of the grooves 11. Therefore, the heat transfer surface composed of this grooved tape promotes the effect of the heat transfer surface formed of the grooved tape shown in FIG. 14.

As is apparent from the foregoing description, according to the present invention, there is provided a heat transfer surface in which final products are not different in heat transfer coefficient and a higher heat transfer coefficient may be obtained. According to the heat transfer surface, it is possible to regularly distribute the active and inactive restricted openings as desired and to supply the cavities with a suitable amount of liquid. Also, the heat transfer surface according to the invention is superior in productability.

What is claimed is:

1. A heat transfer surface assembly having groups of cavities and groups of restricted openings in an outer surface region of a heat transfer wall, said heat transfer assembly comprising a laminate of a plurality of elongate thin plate members which are arranged side-by-side with each other on a base member of said heat transfer wall and which are laminated to said base member; each of said elongate thin plate members including a number of elongate cavities which are laterally arranged with respect to the length of the plate members and are parallel with each other, said elongate cavities being closed at an outer surface portion of said plate members and having openings at both ends; the adjacent cavities of adjacent plate members being in communication with each other via openings at adjacent ends between said side-by-side plates members; said outer portions of the plate members having a plurality projections that extend outwardly from the plate members in a direction generally parallel to the elongate cavities, spaces between the adjacent projections of adjacent plate members defining the groups of restricted openings and said restricted openings allowing entry and egress of fluids into and out of said cavities.

2. A heat transfer surface assembly according to claim 1, wherein said base member comprises a tubular member and the plurality of thin plate members are helical windings of a continuous length of a single thin plate arranged on and laminated to said tubular member.

3. A heat transfer surface assembly according to claim 2, further comprising additional plate members of another continuous length of a thin plate arranged as windings on outer exposed portions of the windings arranged on and laminated to the tubular member.

4. A heat transfer surface assembly according to claim 1, further comprising additional elongate plate members laminated in plural layers so that the thin plate members define elongate cavities in different layers that intersect with each other in a cross-like manner.

5. A heat transfer surface assembly according to claim 1, wherein a space between the adjacent thin plate members is different from another space between other adjacent thin plate members in area, so that said restricted openings have different cross sectional areas between rows of the parallel thin plate members.

* * * * *